United States Patent [19]

Hellberg

[11] 4,186,094

[45] Jan. 29, 1980

[54] APPARATUS FOR ELIMINATING BY FLOTATION IMPURITIES IN THE FORM OF SOLID PARTICLES CONTAINED IN A LIQUID

[75] Inventor: Enar V. Hellberg, Brussels, Belgium

[73] Assignee: Swemac S.A., Brussels, Belgium

[21] Appl. No.: 834,883

[22] Filed: Sep. 20, 1977

Related U.S. Application Data

[63] Continuation-in-part of Ser. No. 784,937, Apr. 5, 1977, abandoned.

[30] Foreign Application Priority Data

Apr. 12, 1976 [BE] Belgium ..... 166085

[51] Int. Cl.[2] ..... B03D 1/24

[52] U.S. Cl. ..... 210/221 P; 210/261; 210/262; 261/62; 261/122; 261/DIG. 75

[58] Field of Search ..... 210/44, 221 P, 221 R, 210/220, 63 R, 261, 262, 218; 55/226, 256, 257; 261/62, DIG. 75, 122, 124, DIG. 26

[56] References Cited

U.S. PATENT DOCUMENTS

| | | | |
|---|---|---|---|
| 2,746,605 | 5/1956 | Baum | 210/221 P |
| 2,874,842 | 2/1959 | Krofta | 210/221 P |
| 3,545,731 | 12/1970 | McManus | 210/220 |
| 3,669,883 | 6/1972 | Huckstedt et al. | 210/221 P |
| 3,842,004 | 10/1974 | Nagahama | 210/44 |
| 3,927,152 | 12/1975 | Kyrias | 261/122 |

*Primary Examiner*—Benoit Castel

*Attorney, Agent, or Firm*—Haseltine, Lake & Waters

[57] ABSTRACT

Apparatus for eliminating impurities by flotation of such impurities wherein a stream of air is injected into a flow of liquid in a flotation cell so as to form distributed air bubbles fixed on the impurities, which air bubbles rise to the surface for their discharge as foam.

14 Claims, 7 Drawing Figures

65
60
55
49
48
0
0,5
1,0
1,5

APPARATUS FOR ELIMINATING BY FLOTATION IMPURITIES IN THE FORM OF SOLID PARTICLES CONTAINED IN A LIQUID

BACKGROUND OF INVENTION

This application is a Continuation-In-Part of Ser. No. 784,937 filed Apr. 5, 1977, now abandoned.

The present invention relates to an apparatus for the elimination by flotation of impurities which are in the form of solid particles contained in a liquid, in which apparatus a stream of air is injected into a flow of the liquid in a flotation cell, in such a manner as to form air bubbles which are distributed in the liquid, are fixed on the impurities, and rise to the surface so as to form a foam charged with such impurities and which is discharged from the surface of the liquid.

A flotation apparatus of the kind described above is known for the removal of ink from paper pulp prepared from old papers according to which air is introduced directly into the bottom of the cell by suction with the aid of a propeller which also serves for the intimate mixing and distribution of the fibrous suspension in the cell.

Another example of a flotation apparatus is described in Gibbs U.S. Pat. No. 2,695,710. Bubbles are introduced into the cell by introducing an air-charged liquid through a header at the bottom of the cell to mix with the main body of liquid being treated. The separated sludge is mechanically skimmed from the top of the tank.

In Jones U.S. Pat. No. 3,175,687 aerated water is mixed with the liquid to be treated as the latter flows through an inlet riser into the cell.

In Albrektsson, et al., U.S. Pat. No. 2,793,185, in one embodiment aerated water is introduced into the liquid to be treated as the latter flows over a wall into the flotation cell, and the froth is mechanically skimmed; in another embodiment the froth is removed from the top of the cell by a suction nozzle. In Callow U.S. Pat. No. 1,176,428 froth is also drawn off the top by suction.

SUMMARY OF THE INVENTION

The present invention has as one of its objects an apparatus for permitting the adjustment of the dimensions of bubbles independent of the volume of air mixed with the water which is to be purified. It has been discovered that such independent control of bubble size and the air liquid ratio permits improved selective separation of impurities by flotation. Thus, for example in the case of the de-inking of defibred, pretreated paper pulp prepared from old papers, it is now possible to obtain different bubble dimensions for the flotation of the inks, for the flotation of fillers such as kaolin, or for the flotation of fibres, and thus to proceed to their selective separation.

The present invention has as a particular object an apparatus for providing adjustment of bubble dimensions independently of the volume of air mixed with the fluid to be purified.

To this end, according to one aspect of the invention, before injecting the air and the liquid into the flotation cell, this liquid is circulated in at least one mixing chamber in the form of a layer, preferably 2.5–4.0 mm. thick, while the air is simultaneously admitted into this layer of liquid, preferably transversely of the path of the latter and along a portion of this path.

In cases where the liquid is a suspension of fibres, such as paper pulp, it has in addition been found that the forced passage of the pulp in the form of a layer in a narrow chamber and its encounter with divided air injected transversely onto the fine layer of liquid charged with suspended fibres give rise to an effect of rubbing and cleaning these fibres.

According to one characteristic of the apparatus of the invention the thickness of the layer of liquid in the chamber and consequently the speed of passage of the liquid in the chamber are regulated. Decreasing the thickness of the layer (while maintaining the same liquid feed rate) increases the liquid velocity and reduces bubble size.

In the case of the de-inking of pulp made from old papers, it has been found that the volume of air mixed with the pulp (i.e., the air/liquid ratio) and the speed of passage of the pulp in the mixing chamber have an effect on the whiteness of the pulp, and that by adjusting them it is possible to obtain differences of whiteness ranging from 57° to 66.5° Scan.

These adjustments make it possible to achieve effective purification with minimum rejection.

According to another characteristic of the apparatus, the length of the path of admission of air into the liquid is regulated.

It is thus possible for the amount of air to be accurately proportioned in relation to the layer of liquid passing through the mixing chamber.

Yet another characteristic of the apparatus consists in entraining foam by a flow of air into a hopper and recovering the air for recycling.

In the case of flotation with a plurality of cells, a mixture of air and liquid coming in each case from a mixing chamber is admitted into each cell. It is thus possible to control the dimensions of the bubbles differently from one cell to another, in order to recover the impurities selectively.

When the liquid contains fibres, in order to avoid maximum loss of the latter, it is possible for the foam coming from other cells to be recycled to the liquid to be purified which passes into the first flotation cell.

According to the invention the installation also comprises, upstream of the flotation cell, at least one narrow mixing chamber capable of allowing the passage of a thin layer of liquid to be purified and provided with means capable of admitting the flow of air, preferably transversely of the layer of liquid over a path in the chamber.

According to one characteristic, the mixing chamber is bounded by two parallel walls at a distance from one another, so as to allow the passage of liquid to be purified.

According to another characteristic, the mixing chamber is provided with a means of regulating the distances between the parallel walls.

The invention also features an annular flotation cell into which the liquid to be treated is introduced tangentially. As the liquid whirls around the cell, foam is blown radially inwardly by an air stream, into a central region in which continued whirling of the foam facilitates its separation from the air, the foam dropping into a recovery zone while the air is drawn off and recirculated.

Other features and details of the invention will be seen from the description of an installation given with reference to the drawings accompanying the present specification and showing, solely by way of example, one embodiment of the invention which is suitable in particular for the de-inking of pulp prepared from old papers.

DESCRIPTION OF THE PREFERRED EMBODIMENT

Figure 1:
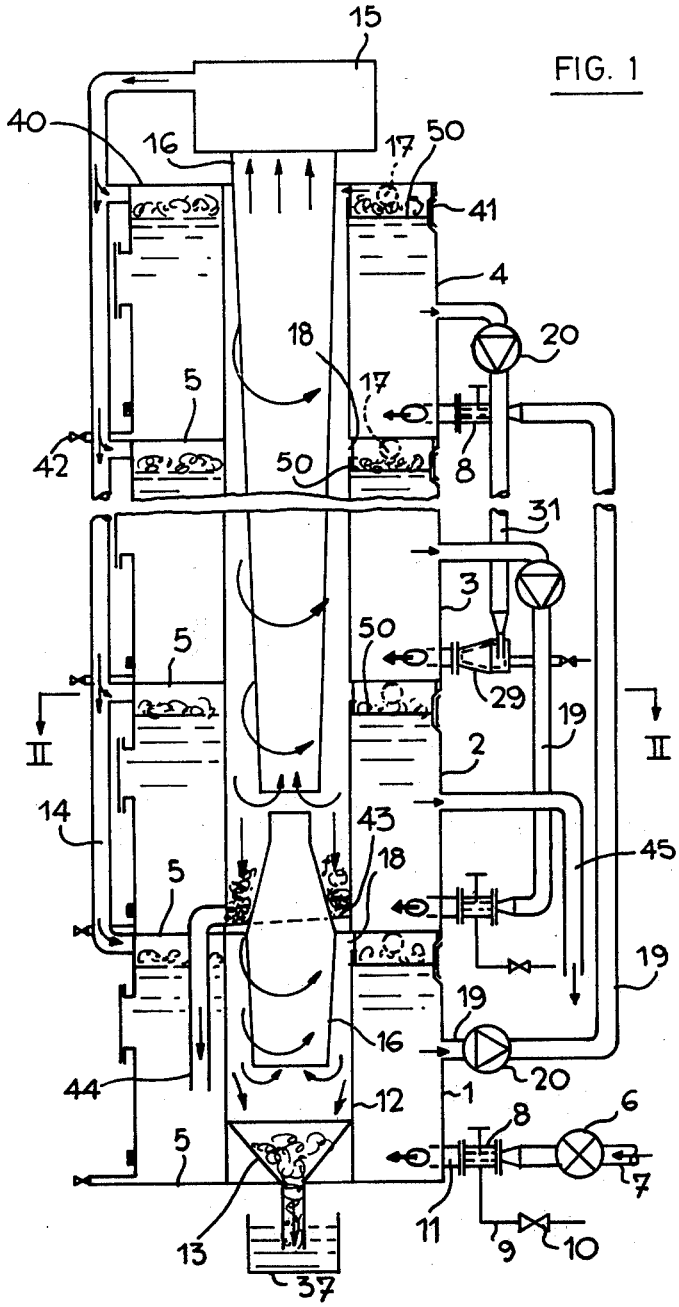
FIG. 1 is a diagrammatical view in elevation of a multi-store installation.

In these drawings the same reference numerals designate identical elements.

The installation comprises four flotation cells 1, 2, 3, 4. These cells are annular and are axially superimposed so as to constitute the four stages of a tower having a plurality of floors 5. Obviously this tower could have a number of stages different from four.

The defibered, chemically pretreated paper pulp in the form of a fibrous suspension containing a foaming agent is delivered by means of a pump 6 through a pipe 7 to the inlet of the cell 1, first passing through a mixing chamber 8. This chamber has a narrow passage in which the fibrous suspension circulates in the form of a thin layer, while at the same time air is admitted into it transversely of the path of this layer of paste and along a portion thereof through a pipe 9 connected to an air pressure source (not shown), with the interposition of a valve 10.

The mixing chamber 8 is in communication with the annular cell 1 through a pipe 11 which leads tangentially into the cylindrical wall of the cell near its floor 5, so that the fibrous suspension is caused to turn about the central pipe 12 of the annular cell. The bubbles created in the suspension are fixed on the impurities and cause them to rise to the surface in the form of foams. The latter are entrained out of the cell through the outlet 18 provided in the pipe 12, partially through the rotational movement of the suspension and partially by a current of air provided above them. A vertical plate 50 disposed above the level of the pulp guides the foams to the outlet. The foams are collected in a hopper 13 surrounding the pipe 12 and received in a reject tank 37 filled with water. The flow of air for the discharge of the foams is introduced into the upper portion of the cell through a pipe 14 connected to a suction device 15 disposed above a frustoconical axial pipe 16 for the recycling of the foam discharge air. This pipe is disposed concentrically in the central foam discharge pipe 12 and is common to all the superimposed cells. The foam discharge air is admitted into the cell through the opening 17 and leaves it through the outlet 18, entraining foam, which through gravity action falls into the hopper 13, while the air escapes through the pipe 16. The latter extends into the adjacent cell 2, forming a cone narrowing in the upward direction and disposed facing the wider pipe for the recycling of the foam discharge air of this adjacent cell and of the other cells 3, 4. The parts constituting the pipe 16 form a cyclone, thus imparting a centrifugal velocity to the foam, permitting the separation of the air which is drawn into this pipe by the action of the suction device 15, whence it is returned to the pipe 14 for reuse for the discharge of foams.

The pulp partially cleaned in the cell 1 leaves the latter through a pipe 19 provided with a pump 20 enabling the pressure to be increased. The pipe 19 generates into the mixing chamber of the next cell 4 situated in the last stage of the tower, and the process applied is identical to that utilized in the first cell, and so on in the other cells. The latter are fed successively with the pulp or water containing fibres of an increasing degree of purity, while cleaned liquid collected in these other cells is in turn recycled to the lower cell.

The foam containing the rejected material from the first cell and other cells can of course either be recycled or discharged at each stage for treatment in a separate device, depending on the type of product for which the pulp is intended.

The installation also comprises a cover 40 closing the cell of the last stage; an inspection window 41 permitting rapid discharge for cleaning purposes; an emptying valve 42 for each cell; a flap 46 in the foam transporting air pipe; a pipe 44 for the discharge of this rejected material in cell 1, and a pipe 45 for the discharge of the accepted pulp in the cell 2 treating the most highly purified pulp.

FIGS. 3, 4, 5, and 6 illustrate respectively two forms of construction of the mixing chamber.

Figure 3:
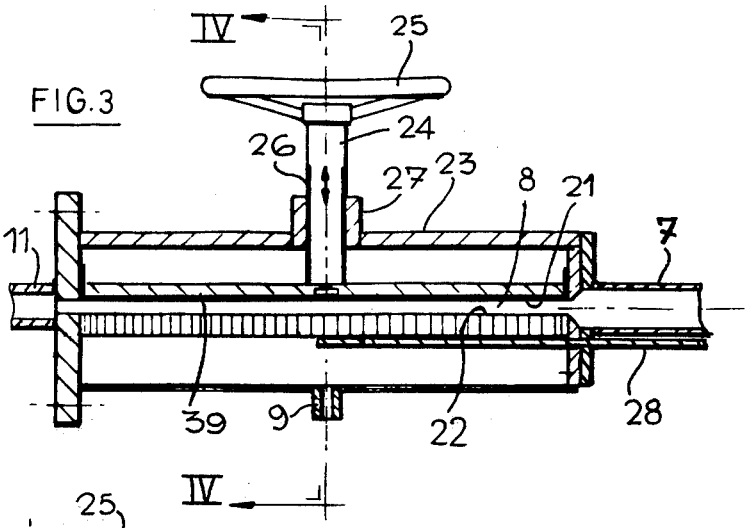
FIG. 3 shows on a larger scale a view in longitudinal vertical section of a mixing chamber.
Figure 4:
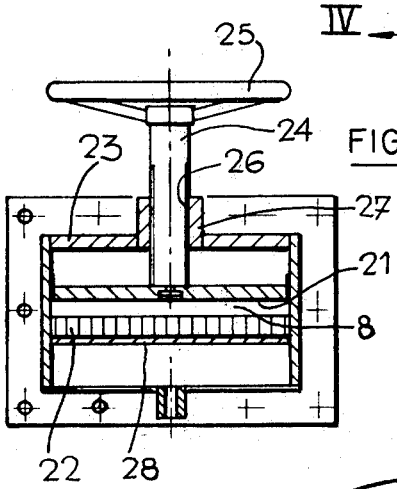
FIG. 4 is a view in section of the line IV—IV in FIG. 3.
Figure 2:
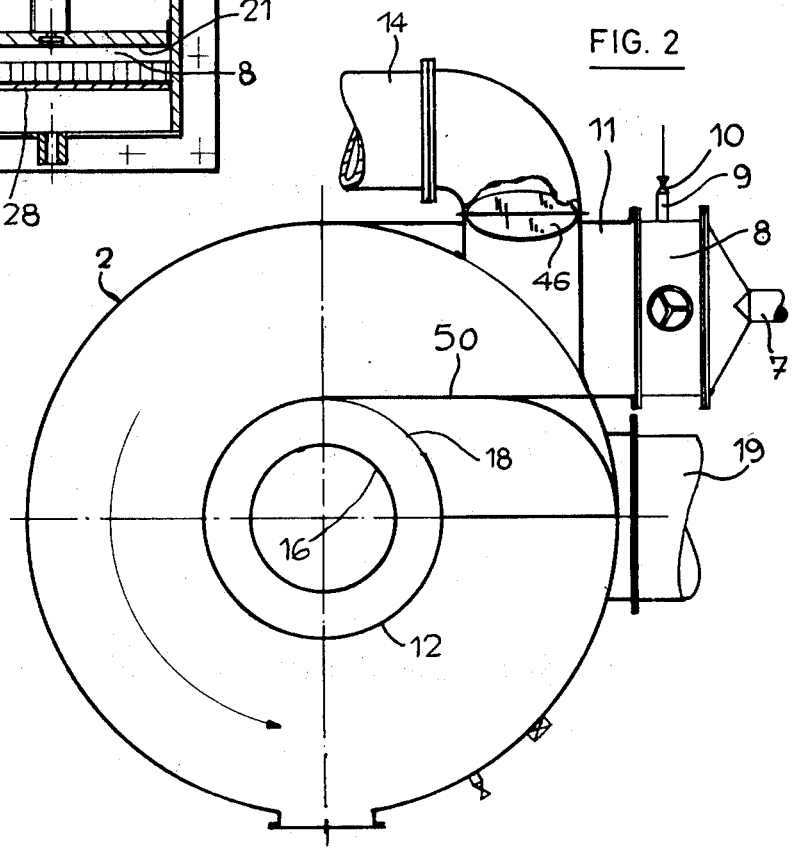
FIG. 2 is a horizontal section on the line II—II in FIG. 1.

In the form of construction shown in FIGS. 3 and 4 the mixing chamber has a rectangular section comprising two parallel plane walls 21, 22 mounted in a parallelpiped body 23, and forming between them a channel in communication with the pulp inlet and outlet pipes 7 and 11. The wall 21 is movable parallel to the wall 22 and is operated by means of a threaded rod 24 guided in a tapped hole 26 provided in a sleeve 27 engaged in the upper adjacent wall of the parallelpiped body permitting by means of a wheel 25 the adjustment of the distance between the parallel walls, in order to determine the thickness of the layer of pulp to be subjected to the action of the jet of air. The wall 21 is provided with a diaphragm ensuring the tightness of the chamber, while the wall 22 is a porous material, in the particular case considered being of fritted glass permitting the passage of the air jets onto the layer of pulp passing through the chamber. It is advantageous for the mixing chamber also to be provided with a plate 28 making it possible to close off part of the surface of the passages provided in the fritted plate so as to regulate the air flow admission surface.

Figure 5:
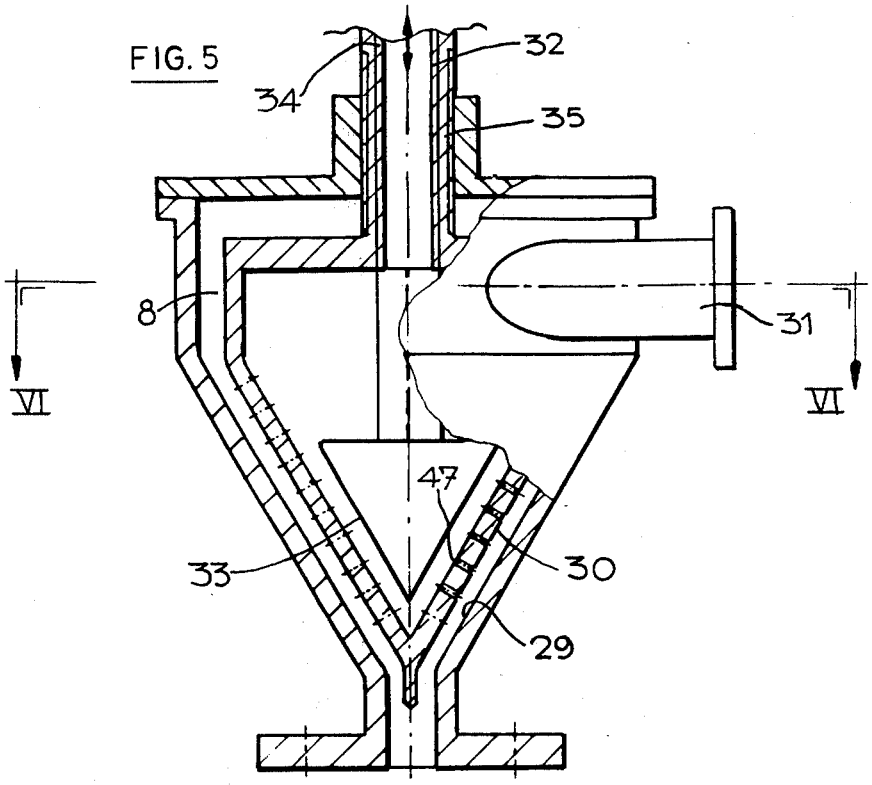
FIG. 5 shows on a larger scale and in vertical section a first form of construction of a mixing chamber.
Figure 6:
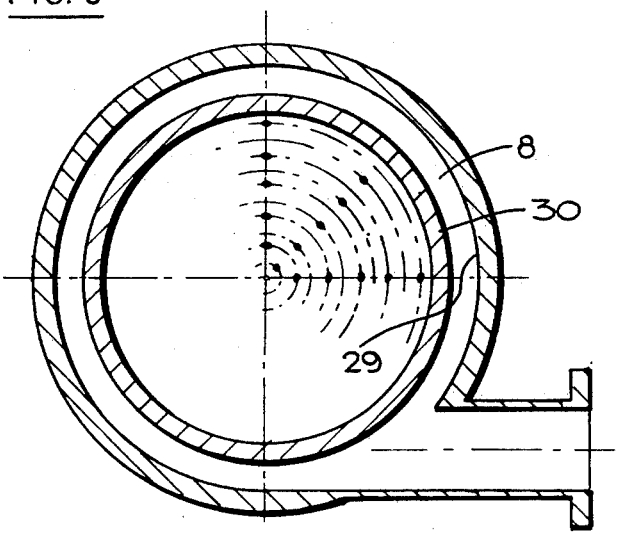
FIG. 6 is a view in section on the line VI—VI in FIG. 5.

In the embodiment shown in FIGS. 5 and 6, the mixing chamber 8 is conical in shape and has two parallel conical walls 29, 30 spaced apart from one another to form the passage for the pulp through them. The pulp is fed into the chamber through a nozzle 31 leading tangentially into the chamber through the wall 29 in order to impart to the pulp a rotational movement while receiving the air injected through the channels 47 provided in the inner wall 30, which are in communication with an air inlet 32 connected to a compressed air source (not shown). The inner cone 30 is adapted to slide axially in the outer cone 29 so as to adjust the space between these walls and consequently the thickness of the layer of pulp. For this purpose the inner cone, which may be rotatable, is controlled by a tube 32 which at the same time forms the air supply pipe. A conical obturator 33 disposed inside the cone 30 is mounted on two rods 34 and 35 sliding in end walls of the cone 30, and makes it possible, when desired, to close off a part of the holes of the air distributor cone, in order in this way to adjust the surface admitting the flow of air into the mixing chamber. The adjustment of the air flow independently of the speed and rate of flow of the pulp makes it possible to create in the cells a type of bubble suitable for the flotation of inks, for the flotation of kaolin, or for the flotation of fibres, and thus to achieve selective separation of these components.

Figure 7:
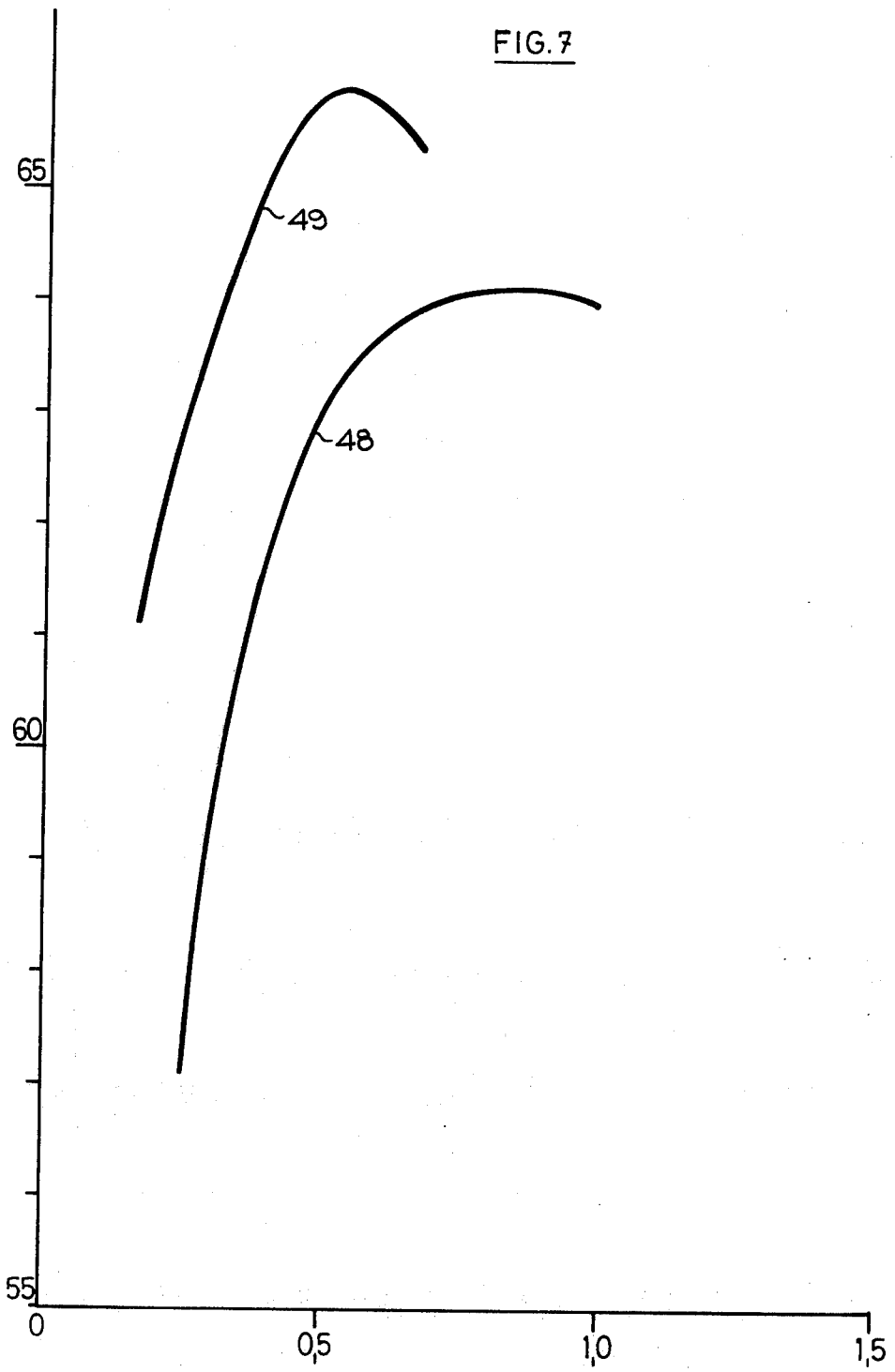
FIG. 7 is a diagram showing whiteness curves.

The invention which has been described relates to an installation for the de-inking of paper pulp. It could be used for other applications, for example for the purification of ores or for the purification of white water by flotation of fibres. Laboratory tests have made it possible to establish a diagram, which in FIG. 7 shows pulp whiteness curves 48 and 49 plotted against the ratio of air volume to pulp volume and against the speed of the pulp in the mixing chamber. On the abscissa is indicated the ratio of liter of air to liter of pulp, and on the ordinate the whiteness of the pulp in degrees Scan. The curve 48 shows a pulp whiteness for a pulp speed of 4.23 meters per second, while the curve 49 shows a pulp whiteness for a pulp speed of 6.35 meters per second.

By adjustment of the air-pulp mixture and of the speed of the pulp in the mixing chamber it is possible to obtain differences of whiteness ranging from 57° to 66.5° Scan. The tests were carried out with old papers of the "magazine" type, containing about 50% of mechanical pulp having an original whiteness of the unprinted edges of 66.5° Scan.

By the apparatus of the invention the whiteness of the printed parts containing about 2% of ink can be increased from 46° to 66.5° Scan, with a retention of 20 minutes. After 2.5 minutes retention the whiteness has already passed from 46° to 66.5° Scan. The best present conventional apparatus makes it possible with the same paper to obtain 62.3° Scan after 20 minutes retention and about 54° Scan after 2.5 minutes.

Other information relating to the invention appears in an article entitled "Deinking Takes A New Shape" in the September, 1976 issue of Pulp & Paper International, said article hereby being incorporated by reference.

It is obvious that the invention is not limited exclusively to the embodiments illustrated and that many modifications can be made to the form, arrangement, and constitution of certain of the elements used in its performance, without departing from the scope of the present invention, provided that these modifications are not in contradiction with any of the following claims.

What is claimed is:

1. Apparatus for elimination by flotation of solid particle impurities contained in a liquid, which comprises at least one flotation cell having an inlet for the liquid to be treated and separate outlets for foam containing impurities and for cleaned liquid, and, upstream of said inlet, a mixing chamber through which the liquid passes to said inlet and is charged with air to form bubbles therein, said mixing chamber comprising opposed parallel walls forming a flow passage for the liquid through said chamber at least one of said walls having pores therethrough, aeration means for providing a flow of air through said pores to form bubbles in the liquid flowing through said passage, adjustment means for relatively moving said walls toward and away from each other to respectively decrease and increase the width of the passage between them and hence the velocity of the flow of liquid through said passage, thereby inversely changing the size of bubbles formed, and inlet means for providing a flow of the liquid into the upstream end of said passage.

2. Apparatus according to claim 1 wherein said adjustment means is adjustable to provide a spacing between said walls of from 2.5 to 4 mm.

3. Apparatus according to claim 1 wherein said walls are conically shaped and coaxial, and said adjustment means relatively moves said walls axially.

4. Apparatus according to claim 3 wherein said inlet means is arranged to provide a tangential flow of the liquid into said passage.

5. Apparatus according to claim 3 which includes means for conducting the flow of liquid away from said passage at a velocity no higher than that of the liquid flow through said passage.

6. Apparatus according to claim 3 which includes means for controlling the flow rates of liquid to said inlet means and of air to said aeration means.

7. Apparatus according to claim 3 which includes means adjustable to close a plurality of said pores.

8. Apparatus for elimination by flotation of solid particle impurities contained in a liquid, which comprises at least one enclosed flotation cell, an inlet for admitting the liquid into the cell, a mixing chamber through which the liquid passes to said inlet and is charged with air to form bubbles therein, said mixing chamber comprising opposed parallel walls forming a flow passage for the liquid through said chamber at least one of said walls having pores therethrough, aerating means for providing a flow of air through said pores to form bubbles in the liquid flowing through said passage which attach to and float impurities to form a surface foam on the liquid in the cell adjustment means for relatively moving said walls toward and away from each other to respectively increase and decrease the width of the passage between them and hence the velocity of the flow of liquid through said passage, thereby inversely changing the size of said bubbles, outlets for separately discharging said foam and cleaned liquid from said cell, and foam ejection means for directing a stream of air into said surface foam to blow the foam toward and out its outlet, said foam ejection means further including suction means and duct means for recycling the air of said air stream.

9. Apparatus according to claim 8 wherein said cell is generally cylindrical, said inlet is in the lower part of said cell and is tangential to the outer wall thereof to provide a generally circular flow pattern of the incoming liquid about the cell axis, and said outlet for foam comprises an axial discharge pipe in said cell opening through the cell bottom and extending to said foam layer.

10. Apparatus according to claim 9 wherein said duct means comprises a tubular pipe disposed axially within said discharge pipe having an open end exposed to the air discharged with the foam into said discharge pipe and communicating at its opposite end with said suction means.

11. Apparatus according to claim 10 wherein said aerating means comprises a mixing chamber through which the liquid flows to said inlet and having means for injecting air into the liquid passing therethrough.

12. Apparatus according to claim 11 which comprises a plurality of said cells arranged to be stacked coaxially on top of one another, with said discharge pipes communicating.

13. Apparatus according to claim 12 wherein said tubular pipes are arranged to communicate when said cells are so stacked, and which includes a single said suction means for servicing said communicating tubular pipes and providing said air streams to said foam ejection means of said cells.

14. Apparatus according to claim 13 wherein said aerating means of each said cell is provided with means for regulating the bubble size produced by air injection thereby into the liquid, and which includes piping for connecting the outlet for cleaned liquid of each cell except one to the inlet of another said cell to provide series treatments of the liquid in the plurality of cells.

* * * * *

UNITED STATES PATENT AND TRADEMARK OFFICE

CERTIFICATE OF CORRECTION

PATENT NO. : 4,186,094

DATED : JANUARY 29, 1980

INVENTOR(S) : ENAR VALENTIN HELLBERG

It is certified that error appears in the above—identified patent and that said Letters Patent is hereby corrected as shown below:

Claim 8, line 39

"increase and decrease" should read

--decrease and increase--

Signed and Sealed this

*Thirtieth* Day of *September 1980*

[SEAL]

*Attest:*

SIDNEY A. DIAMOND

*Attesting Officer*

*Commissioner of Patents and Trademarks*